United States Patent [19]

Sato

[11] Patent Number: 4,807,547

[45] Date of Patent: Feb. 28, 1989

[54] AUTOMATIC BUTTON SEWING MACHINE FOR STITCHING BUTTONS IN SERIES ON A FABRIC

[76] Inventor: Manabu Sato, 1428, Nishi Shinmachi, Tosushi, Saga, Japan

[21] Appl. No.: 165,299

[22] Filed: Mar. 8, 1988

[51] Int. Cl.[4] ..... D05B 3/14

[52] U.S. Cl. ..... 112/112; 112/114

[58] Field of Search ..... 112/110, 112, 311, 320, 112/111, 114, 70, 65

[56] References Cited

U.S. PATENT DOCUMENTS

| | | | |
|---|---|---|---|
| 3,509,838 | 5/1970 | Bowin | 112/110 |
| 3,974,787 | 8/1976 | Kraatz et al. | 112/121.12 |
| 4,465,002 | 8/1984 | Sahl | 112/111 |
| 4,594,953 | 6/1986 | Ando et al. | 112/112 |

*Primary Examiner*—Andrew M. Falik

*Attorney, Agent, or Firm*—Barnes & Thornburg

[57] ABSTRACT

An automatic button sewing machine for stitching buttons in series on a fabric includes a working table for supporting the fabric and a back-up plate movably disposed on the working table to back-up the fabric during button sewing operations. A button holder is provided for picking up a button and placing it at a desired position on the fabric. A cloth holding and shifting arm is provided for shifting the fabric from one button to the next. The cloth back-up plate, the button holder and the cloth holding and shifting arm are moved together, thereby placing the buttons at appropriate positions on the fabric during button sewing operations.

2 Claims, 3 Drawing Sheets

AUTOMATIC BUTTON SEWING MACHINE FOR STITCHING BUTTONS IN SERIES ON A FABRIC

BACKGROUND OF THE INVENTION

1. Field of the Invention

The present invention relates to a button sewing machine, and more particularly to a machine adapted for stitching buttons on the sleeves of a suit in series.

2. Description of the Prior Art

The known automatic button sewing machine is provided with a working table and cloth back-up plate movably placed on the table. A cloth such as a sleeve of a suit is placed on the cloth back-up plate. The machine is additionally y provided with a button holder vertically movable with respect to the cloth back-up plate. The accompanying drawings show the embodiments of the present invention but for explanatory convenience reference will be made to them. In FIG. 1 the reference numerals 1*a*, 4 and 5 denote the working table, the cloth back-up plate and the button holder, respectively.

Now, suppose that the machine is applied to sew decorative buttons on a sleeve of a suit. The sleeve is hung on the working table being backed up by the back-up plate as shown in FIG. 1, and the button holder is operated to sew buttons at desired positions on the sleeve wherein the button holder and the back-up plate are simultaneously moved about so as to locate the buttons at the desired positions.

The known automatic button sewing machines of such type are adapted for stitching buttons on the sleeves one by one. However if two or more buttons are to be attached in series a manual work is involved in shifting the sleeve portion from button to button. The necessity for manually shifting the sleeve negates the merit of the automated button sewing performance. Another disadvantage is the difficulty of visually locating buttons exactly at desired positions. A misalignment often occurs.

OBJECTS AND SUMMARY OF THE INVENTION

The present invention is directed to solve the problems pointed out with respect to the known button sewing machines, and has for its object to provide an automatic button sewing machine which can locate a plurality of buttons exactly in series.

Another object of the present invention is to provide an automatic button sewing machine which enables an inexperienced operator to stitch buttons on clothes easily.

A further object of the present invention is to provide an automatic button sewing machine which sews buttons on clothes quickly.

Other objects and advantages of the present invention will become more apparent from the following detailed description, when taken in conjunction with the accompanying drawings which show, for the purpose of illustration only, one embodiment in accordance with the present invention.

According to the present invention there is provided a button sewing machine for stitching buttons in series on an object material such as sleeves of suits, which machine includes a working table for holding the object material and a cloth back-up plate movably placed on the working table serving to back-up the object material during button sewing operations. A button holder is provided for picking a button from a button carrier and placing it at a desired position on the object material. A cloth holding and shifting arm is provided for pressing and shifting the object material laced on the table along the surface of the working table. A first driving unit is provided for effecting the ascent and descent of the cloth holding and shifting arm with respect to the working table. An interlocking unit is provided for effecting unitary movement of the cloth back-up plate, the button holder and the cloth holding and shifting arm, to thereby facilitate placement of the button held by the button holder at an appropriate position on the working table. A further driving unit is proved for shifting the cloth holding and shifting arm in the button aligning direction while it presses the cloth against the back-up plate.

DETAILED DESCRIPTION OF THE PREFERRED EMBODIMENT

Figure 1:
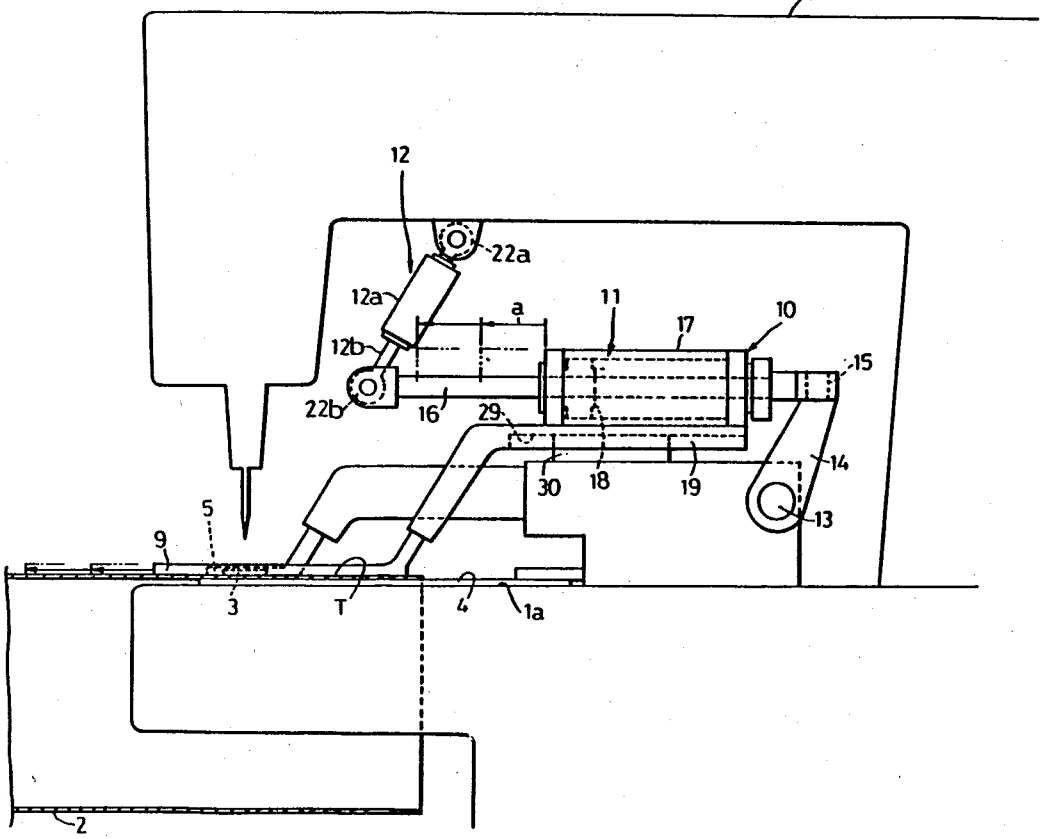
FIG. 1 is a front view showing a button sewing machine embodying the present invention.

The button sewing machine of the present invention, being generally denoted by the reference numeral 1, includes a working table 1*a* extending at one side from the machine body so as to allow an object material such as a sleeve of a suit to hang on. Hereinafter the object material will be referred to the cloth (T). There is provided a cloth back-up plate 4 slidable on the table la, which plate 4 is to back up the cloth (T) as shown in FIG. 1. The reference numeral 5 denotes a button holder. The cloth back-up plate 4 is movable horizontally with respect to the table 1*a*, and the button holder 5 is movable not only horizontally but also vertically.

Figure 2:
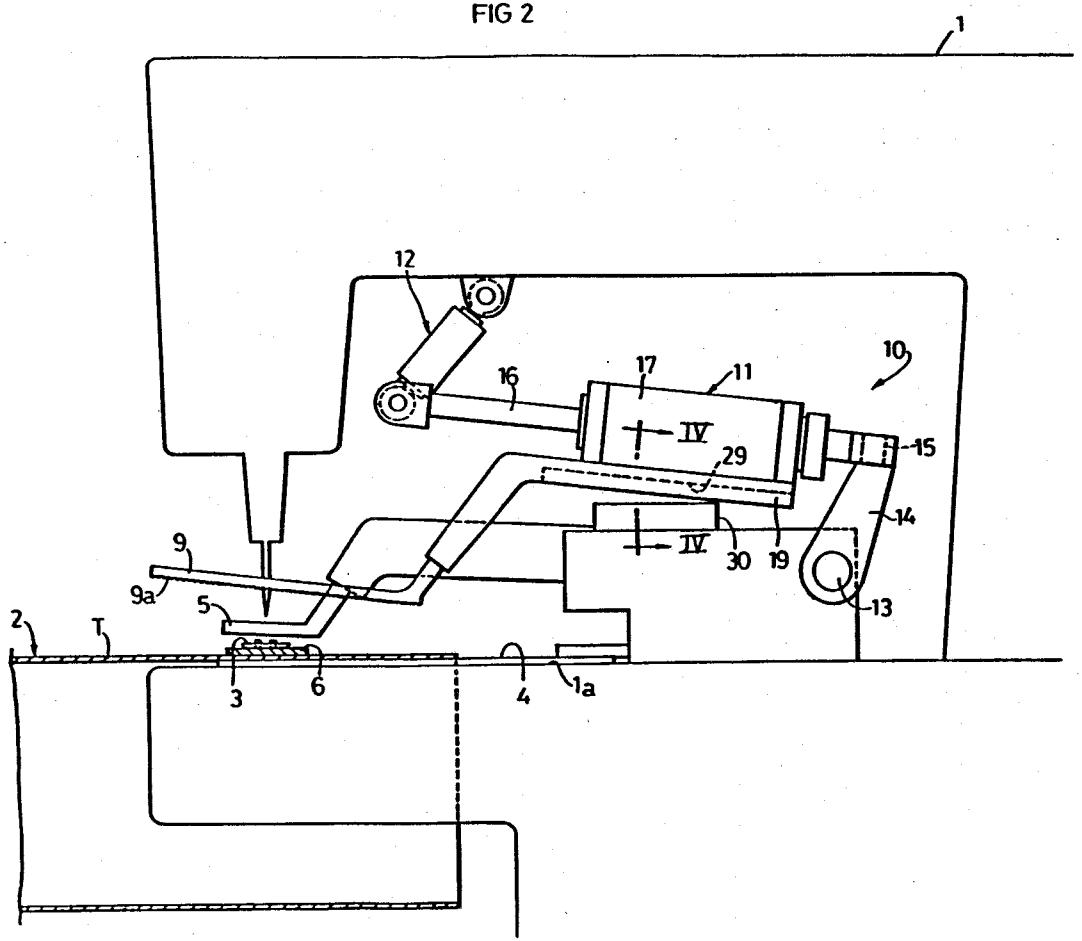
FIG. 2 is a front view showing the machine of FIG. 1 which is ready to receive the cloth.

Referring to FIG. 2, the button holder 5 is caused to descend and picks up a button 3 on a carrier 6, wherein the buttons are supplied onto the carrier one by one by a button feeder (not shown). The button holder 5 is provided with a pair of pinching arms 5*a* whereby the button is securely caught. After the button 3 is picked up the carrier 8 is withdrawn toward the button feeder. The button holder 5 carrying the button 3 is caused to descend and place it at the desired position on the cloth (T).

Figure 3:
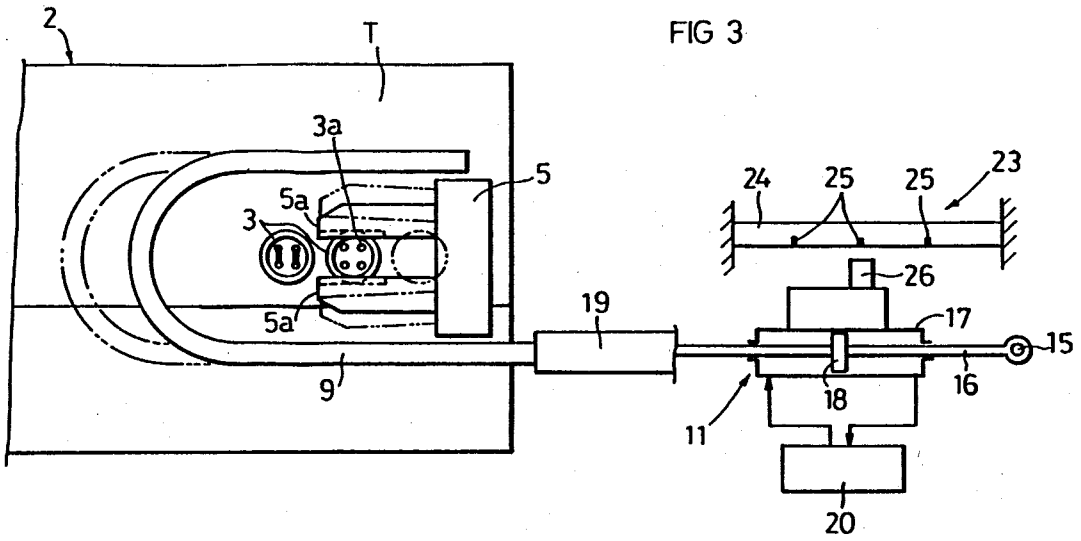
FIG. 3 is a schematic view showing the movement of a holding and shifting arm included in the machine.

The reference numeral 9 denotes a cloth holding and shifting arm whereby the cloth (T) is shifted in the direction of the arrow on the table 1*a*. The cloth holding arm 9 is driven by a feed drive unit 10. As shown in FIG. 3 the arm 9 is U-shaped in which the button holder 5 is situated. Preferably the arm 9 is provided with small projections on its undersurface 9*a* (i.e. the cloth pressing surface) so as to prevent the arm 9 from slipping on the cloth (T).

The feed drive unit 10 includes an arm feeder 11 reciprocally moving so as to enable the arm 9 to move in a direction in which buttons are aligned, and simultaneously an arm lifter 12 is caused to ascend and descend through the operation of the arm feeder 11.

The arm feeder 11 includes a swinging arm 14 connected to the body of the button holder 5 by means of a pivot 13, a shaft 18 having a journal 15 at which the shaft 18 is pivotally connected to the swinging arm 14, a pneumatic cylinder 17 having a piston 18 secured to the shaft 18, the cylinder 17 being reciprocally moved along the shaft 18, and an arm supporting member 19 secured to the undersurface of the pneumatic cylinder 17, the member 19 supporting the cloth holding and shifting arm 9.

As shown in FIG. 3, the cylinder 17 includes a chamber dividable by a piston 18 into a left-hand section and a right-hand section. When the pressure is increased in the left-hand section the pneumatic cylinder 17 moves in the left-hand direction, thereby enabling the cloth holding and shifting arm 9 to push the cloth (T) over a predetermined distance. Then a pressure is increased in the right-hand section, the cylinder 17 returns to its original position. The reference numeral 20 denotes a control valve for adjusting the pneumatic pressure in the cylinder 17.

The arm lifter 12 comprises a pneumatic cylinder 12*a*, whose top end is pivotally connected to a coupling 22*a*, and whose piston 12*b* is pivotally connected to the opposite coupling 22*b* carried on the shaft 16. The coupling connection enables the arm lifter 12 to follow the maneuvering of the button holder 5 vertically and horizontally with respect to the cloth (T) placed on the table 1*a*. Another function of the arm lifter 12 is to vertically swing the arm feeder 11 around the pivot 13. Under the cooperation of the arm lifter 12 and the feed drive unit 10 the cloth holding and shifting arm 9 alternatively takes (1) the position of pressing the cloth (T) as shown in FIG. 1. and (2) the position of waiting for a subsequent operation in its raised posture as shown in FIG. 2.

A distance over which the cloth (T) is shifted is controlled through a sensor unit 23, which includes a reference shaft 24 secured to the body of the machine 1, and a photocell 26 secured to the pneumatic cylinder 17, the photocell 26 being adapted to read one of index members 25 during the movement thereof. In response to the detection of one index member 25 the control valve 20 stops the supply of pressurized air so that the pneumatic cylinder 17 is stopped at a desired position.

In sewing buttons 3 on the cloth (T) the button holder 5 and the cloth back-up plate 4 are caused to maneuver so as to locate the button 3 at a predetermined button position 3*a*. The arm 9 follows the maneuver of the button holder 5 while pressing the cloth (T). The unitary movement of the holder 5 and the arm 9 is ensured by an interlocking unit 28 shown in FIG. 4.

Figure 4:
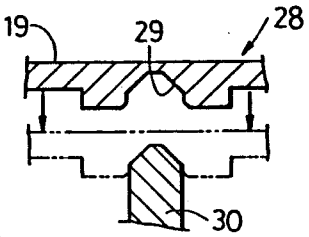
FIG. 4 is a cross-sectional view taken along the IV—IV line in FIG. 2.

Referring to FIG. 4 the interlocking unit 28 will be described:

The interlocking unit 28 includes a groove 29 cut in the undersurface of the arm supporting member 19, and an engaging member 30 adapted to fit in the groove 29. When the arm 19 is in its waiting posture as shown in FIG. 2 the engaging member 30 is disconnected from the groove 29, and when the arm 19 comes into contact with the cloth (T), the groove 29 comes into engagement with the engaging member 30.

The buttons will be sewn on the cloth (T) with stitches in the following manner:

Suppose that the cloth (T) be a sleeve 2. The index members 25 are positioned in accordance with the number and distance between one button and another. In the illustrated embodiment three index members 25 are provided on the reference shaft 24.

The sleeve 2 is hung on the plate 1*a*, and backed up by the back-up plate 4. Then the cuff of the sleeve 2 is positioned at a starting position on the table 1*a* so that the remotest button position from the cuff is the first stitch. The starting position is previously determined in accordance with the number of buttons and a desired distance between one button and another.

After the button positions are set the arm lifter 12 is operated to cause the arm 9 to descend and press the sleeve 2 against the cloth back-up plate 4. At this stage the machine 1 is switched on. A button 3 is supplied to the button carrier 6 by means of a button feeder (not shown). and the button holder 5 picks up the button 3 to place it at the prescribed position on the sleeve 2. Then the button 3 is stitched there. In placing the button at the desired position the arm 9 maneuvers in association with the button holder 5 under the action of the interlocking unit 28 while it presses the sleeve 2 against the back-up plate 4. More specifically the arm 9, the button holder 5 and the cloth back-up plate 4 move together.

When a predetermined number of stitches (normally, nine to thirty-six stitches) are given the machine 1 is stopped, and the pinching arms 5*a* of the button holder 5 are opened to release the button 3 sewn to the sleeve 2. Then the button holder 5 is caused to rise above the sleeve 2.

The control valve 20 is turned on to cause the cylinder 17 to travel over a predetermined distance along the shaft 18, thereby enabling the arm 9 to push the sleeve 2 on the back-up plate 4. In this way the sleeve 2 is shifted to the left (in FIG. 1) by a distance which corresponds to the distance between one button and the next. This shifting distance is previously determined, and maintained by the sensor unit 23.

The next button 3 is supplied onto the carrier 6, and subsequently the same procedure as mentioned above follows. In this way three buttons are sewn one by one by repetition of the same procedures. After the sewing work is finished the arm is raised by the arm lifter 12, and the pneumatic cylinder 17 is returned to the original starting position.

The number of buttons to be sewn, the distance between one button and the next, and the starting position can be changed as desired by changing the positions of the index members 25.

In the embodiment described above the pneumatic cylinder 17 is operated every time when one button is stitched. This repetition of movement continues until the predetermined number of buttons are sewn. However the distances between the buttons are normally the same. Taking advantage of this fact it is possible to arrange that the pneumatic cylinder 17 is caused to move forward by the same distance every time when one button is sewn, and during the repetition the cloth (T) is shifted by an inter-button distance until the predetermined number of buttons are sewn.

Instead of employing the pneumatic cylinder 17 a pulse motor can be used to operate the arm feeder 11.

In the illustrated embodiment the cloth holding and shifting arm 9 is U-shaped as shown in FIG. 3, but instead of providing a single U-shaped arm it is possible to provide two parallel arms secured to the arm supporting member 19.

The arm lifter 12 can be operated by he known means other than the pneumatic cylinder, so that the cloth holding and shifting arm 9 can alternatively take the cloth pressing posture and the waiting posture away from the cloth.

In the foregoing description the cloth (T) is a sleeve of a suit but the present invention is applicable to the button sewing on any other fabric material. According to the present invention buttons can be sewn not only lengthwise of the machine but also crosswise thereof. To effect the crosswise sewing of buttons it has only to modify so that the cloth holding and shifting arm 9 can move crosswise of the machine.

What is claimed is:

1. A button sewing machine for stitching buttons in series on an object material such as sleeves of suits, the machine comprising:

a working table for supporting the object material:

a cloth back-up plate movably placed on the working table for backing up the object material;

a button holder for picking a button from a button carrier and placing it at a desired position on the object material;

a cloth holding and shifting arm for pressing and shifting the object material placed on the table along the surface of the working table;

a first driving means for effecting the ascent and descent of the cloth holding and shifting arm with respect to the working table;

an interlocking means for effecting the unitary movement of the cloth back-up plate, the button holder and the cloth holding and shifting arm, thereby placing the button held by the button holder at an appropriate position on the object material placed on the working table; and a second driving means for shifting the cloth holding and shifting arm in the button aligning direction while it presses the cloth against the back-up plate.

2. A button sewing machine as defined in claim 1, wherein the first and second driving means include pneumatic cylinders.

* * * * *